United States Patent [19]

Jendrick

[11] 4,351,519

[45] Sep. 28, 1982

[54] SHEET FEEDING APPARATUS

[75] Inventor: Rodney J. Jendrick, Newark, N.Y.

[73] Assignee: Xerox Corporation, Stamford, Conn.

[21] Appl. No.: 70,598

[22] Filed: Aug. 29, 1979

[51] Int. Cl.[3] ..... B65H 3/06

[52] U.S. Cl. ..... 271/117; 271/127; 271/164

[58] Field of Search ..... 271/117, 118, 164, 162, 271/127, 126, 171, 170, 109

[56] References Cited

U.S. PATENT DOCUMENTS

| | | | |
|---|---|---|---|
| 2,893,729 | 7/1959 | Perzentka | 271/170 X |
| 3,647,207 | 3/1972 | McPherson | 271/164 |
| 3,689,064 | 9/1972 | Kuksa | 271/164 |
| 3,977,666 | 8/1976 | Suzuki et al. | 271/164 X |
| 4,037,953 | 7/1977 | Sone et al. | 271/117 X |
| 4,098,501 | 7/1978 | Tani et al. | 271/117 |
| 4,231,566 | 11/1980 | Suzuki | 271/117 |

FOREIGN PATENT DOCUMENTS

| | | | |
|---|---|---|---|
| 2229 | 6/1979 | European Pat. Off. | 271/117 |
| 53-113534 | 10/1978 | Japan | 271/117 |

*Primary Examiner*—Bruce H. Stoner, Jr.

[57] ABSTRACT

Sheet feeding apparatus comprising a rotatable feed roll shaft having one feed roll permanently attached at one end and a second axially movably mounted feed roll on the other end of the shaft with a yoke means to axially move the roll. The feeding apparatus is used with a sheet cassette which, when inserted in the sheet supply station, engages positioning means responsive to the insertion of the cassette which thereby automatically positions the movable feed roll so that both feed rolls are positioned substantially the same distance from the sheet edge irrespective of the size of the sheet material. In this manner the sheet feeding apparatus automatically adjusts itself for feeding sheets of various sizes.

10 Claims, 6 Drawing Figures

SHEET FEEDING APPARATUS

CROSS REFERENCE TO RELATED APPLICATION

Reference is made to copending application of Donald J. Weikel, Jr. and John S. Bernhard filed concurrently herewith entitled Reproducing Apparatus Ser. No. 070,597 now U.S. Pat. No. 4,219,270; and to copending application of William E. Kramer and Frank P. Malinowski filed concurrently herewith entitled Sheet Alignment and Feeding Apparatus Ser. No. 070,599, now U.S. Pat. No. 4,266,762.

BACKGROUND OF THE INVENTION

This invention relates to sheet feeding apparatus and in particular to a sheet feeder utilizing a cassette as a supply of individual sheets and a mechanism for locating the feed rollers for feeding the sheets.

In the automatic reproducing apparatus available today, individual sheets of copy paper are separately fed through the copier and processed one at a time. In this process it is convenient to have a supply stack of sheets from which to feed the individual sheets. Modern day business desires require that a copier be capable of faithfully reproducing original documents of various sizes, configurations and on various types of copy sheet. To facilitate this operational flexibility, it has been customary to provide the supply of cut sheets in a cassette form. Typically, each cassette comprises a box like base support member with walls on all four sides to confine the cut sheets to the contained space. The base support which has an aperture in its base has a tray member supported on it so that when a lifting tongue is inserted through the aperture the leading edge of the tray member with a stack of sheets on it is lifted into feeding engagement with a pair of separator feed rolls.

Typically, an office has several such cassettes, each of which is designed to contain sheets of predetermined width and length. In feeding the sheets from the cassettes care must be taken in the location of the separator feed roller. With reproducing apparatus capable of accomodating copy sheets of several sizes, if the feed rollers are fixed they will contact the sheets to be fed at different points depending on the size of the sheet. To insure aligned feeding of sheets, substantially the same feeding forces should act on each side of a sheet being fed. To achieve this the feed rolls should be positioned such that they act on both sides of the sheet in the same way. If the action of the feed rolls is not the same on both sides of the sheet being fed, the sheets may become misaligned and cause paper jams in their path through the copier. Specifically, in a sheet feeding system using a forward buckle of the sheet over corner snubbers, if the feeding forces on both sides of the copy sheet are not the same the sheets will tend to skew in one direction eventually resulting in a jammed machine.

PRIOR ART STATEMENT

Sheet separators and feeders have previously been provided wherein either the feed rollers are mounted to be slidingly adjustable for movement on a drive shaft or the side guide rails of the sheets are laterally adjustable to accomodate sheets of various sizes. See for example U.S. Pat. No. 2,893,729 wherein both the feed rollers and the side guide rails are manually adjustable to provide proper positioning in placing sheets in the feeder and in accomodating sheets of various sizes.

It has also been proposed to vertically position feed rollers in response to the loading of a stack of sheets. U.S. Pat. No. 4,037,953 describes a cassette loading apparatus wherein in the center of a sheet loading deck the fixed feed rolls have a lever type device inserted between them which contacts a fresh stack of sheets as it is about to be inserted onto the loading deck. The lever is positioned such that upon manual insertion of a stack of sheets into the cassette, it contacts the stack of sheets and in response lifts the feed rollers vertically until the center of rotation of the paper feeding rollers is positioned on the uppermost sheets of the stack.

It has further been proposed to horizontally position sheet feed rolls to accomodate different cassettes filled with different size sheets. In U.S. Pat. No. 3,647,207 a pair of feed rolls both of which are fixedly mounted within a feeding mechanism are manually located about the center line of a stack of sheets to insure accurate alignment of the sheets as they are fed from a cassette. This is achieved by means of a biasing of the feeding mechanism in one direction, a manually movable locator plate and a cable and pulley arrangement so that the feeding mechanism is moved in either direction one half the distance the locator plate moves thereby maintaining its centerline position.

U.S. Pat. No. 4,098,501 discloses a cassette sheet feeder with two separator feed rolls on a driven shaft one roll of which is fixed in position above the cassette a fixed predetermined distance from the side wall. The other separator feed roll is axially movable and embraced by a roller carrier which is biased into engagement with the opposite side wall. This roller carrier is manually moved against a restraining force toward the opposite edge guide to permit insertion of a rigid structural insert in the frame of a predetermined size for each size cassette. For different size cassettes different size inserts are manually mounted on the frame thereby adjusting the location of the one axially movable separator feed roll.

A similar device is shown in Japanese Patent Application No. 52-29050, Publication No. 53-113534 dated Oct. 4, 1978. In that device an adapter for adjusting the position of one feed roll has a cut out section for engagement with the sides of sheet cassettes of various sizes.

SUMMARY OF THE INVENTION

In accordance with this invention an improved sheet feeding apparatus is provided. This reproducing apparatus has the flexibility of being able to accurately feed copy sheets of various sizes from a cassette supply.

More particularly, the present invention is directed to sheet feeding apparatus comprising a rotatably driven feed roll shaft with one feed roll mounted on the shaft a fixed distance from one end of the shaft and a second feed roll axially movably mounted on the shaft with means to move the second feed roll. A sheet cassette is inserted into a cassette guide to come into feeding position with the feed roll and as the cassette is inserted responsive means associated with means to position the second feed roll on the shaft contacts the cassette edge and automatically properly positions the movable feed roll on the shaft.

Accordingly it is an object of the present invention to provide a new sheet feeding apparatus.

It is a further object of the invention to provide a sheet feeding apparatus for use with sheet cassettes of various sizes.

It is a further object of the invention to provide means for automatically adjusting the position of a sheet feed roller responsive to the size of the sheet being fed.

It is an additional object of the invention to provide a sheet feeding apparatus for accurately feeding cut sheets of various sizes.

For a better understanding of the invention as well as other objects and further features thereof, reference is had to the following drawings and description.

DESCRIPTION OF PREFERRED EMBODIMENT

The invention will now be described by reference to a preferred embodiment of the reproducing apparatus.

Figure 1:
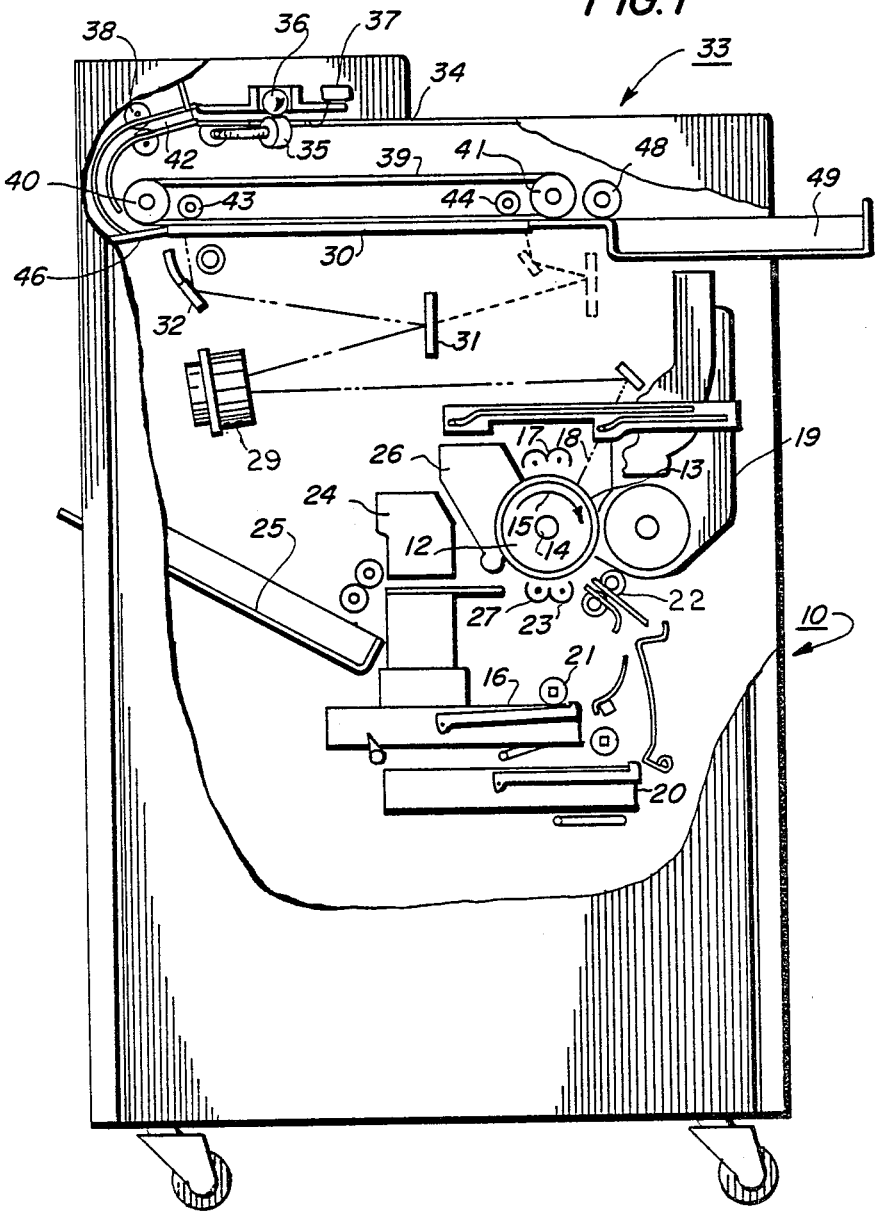
FIG. 1 is a schematic representation of an automatic xerographic reproducing apparatus of the present invention.

Referring now to FIG. 1 there is shown by way of example an automatic xerographic reproducing machine 10 which includes the sheet feeding apparatus. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of zerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a cleaning blade.

Normally, when the copier is operated in a conventional mode, the original document to be reproduced is placed image side down upon a horizontal transparent viewing platen 30 and the stationary original then scanned by means of a moving optical system. The scanning system fundamentally consists of a stationary lens system 29 positioned below the right hand margin of the platen as viewed in FIG. 1 and a pair of cooperating movable scanning mirrors 31, 32 which are carried upon carriages not illustrated. For further description and greater details concerning this type of optical scanning system reference is had to U.S. Pat. No. 3,832,057 to Shogren.

The illustrated apparatus is also provided with a document handler 33 which includes an input station, a copying sheet receiving slot 34, registration assist rolls 35, 36 and switch 37. When a sheet is inserted it makes switch 37 which activates registration assist rolls 35 and 36 which feed the sheet forward and align it against the rear edge guide of the document handler. The pinch rolls 38 are activated to feed a document around the 180° curved guides onto the platen 30. The platen belt transport is comprised of a single wide belt 39 having one run over the platen 30. The belt 39 is wrapped about two pulleys 40 and 41 which are arranged such that the belt surface at the bottom of the pulley with the assistance of input backup roll 43 and output backup roll 44 is in light contact with the platen. The document is driven by the belt 39 across the platen until the trailing edge of the document has cleared registration edge 46 after which the platen belt transport is stopped and the direction in which the document is driven is reversed so that it is registered against registration edge 46 and is now ready for copying. Once in position, the scanning optical system is activated and the document is scanned by full rate mirror 32. At the end of scan the full rate mirror 32 and the half rate mirror 31 are in the positions shown in phantom in FIG. 1. After copying the platen belt transport is again activated and the document is driven off the platen by the output pinch rolls 48 into the document catch tray 49.

It is believed that the foregoing general description is sufficient for purposes of the present application to illustrate the general operation of an automatic xerographic copier 10 which can embody the apparatus in accordance with the present invention.

Figure 2:
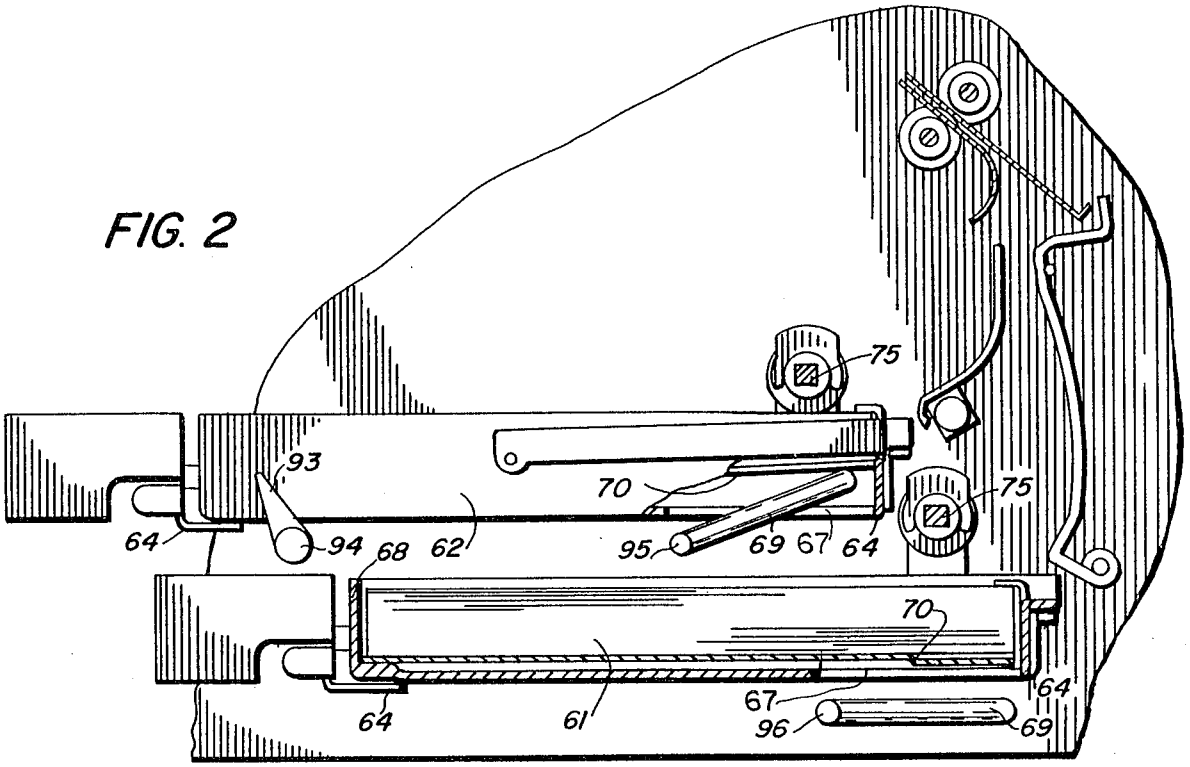
FIG. 2 is an enlarged schematic of a portion of the reproducing apparatus showing in greater detail the sheet feeding apparatus of the present invention.
Figure 3:
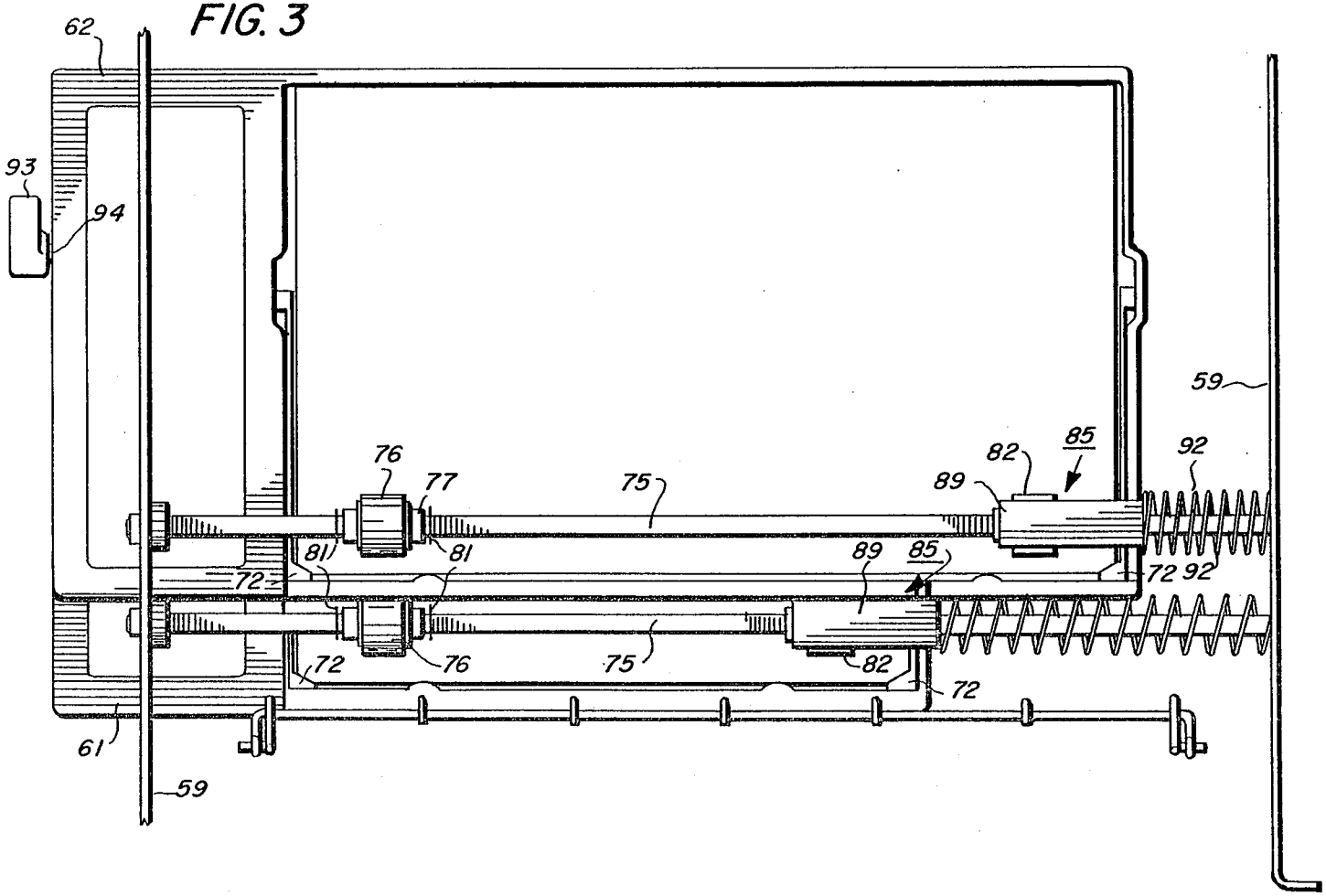
FIG. 3 is a top view of the sheet feeding apparatus of the present invention.
Figure 4:
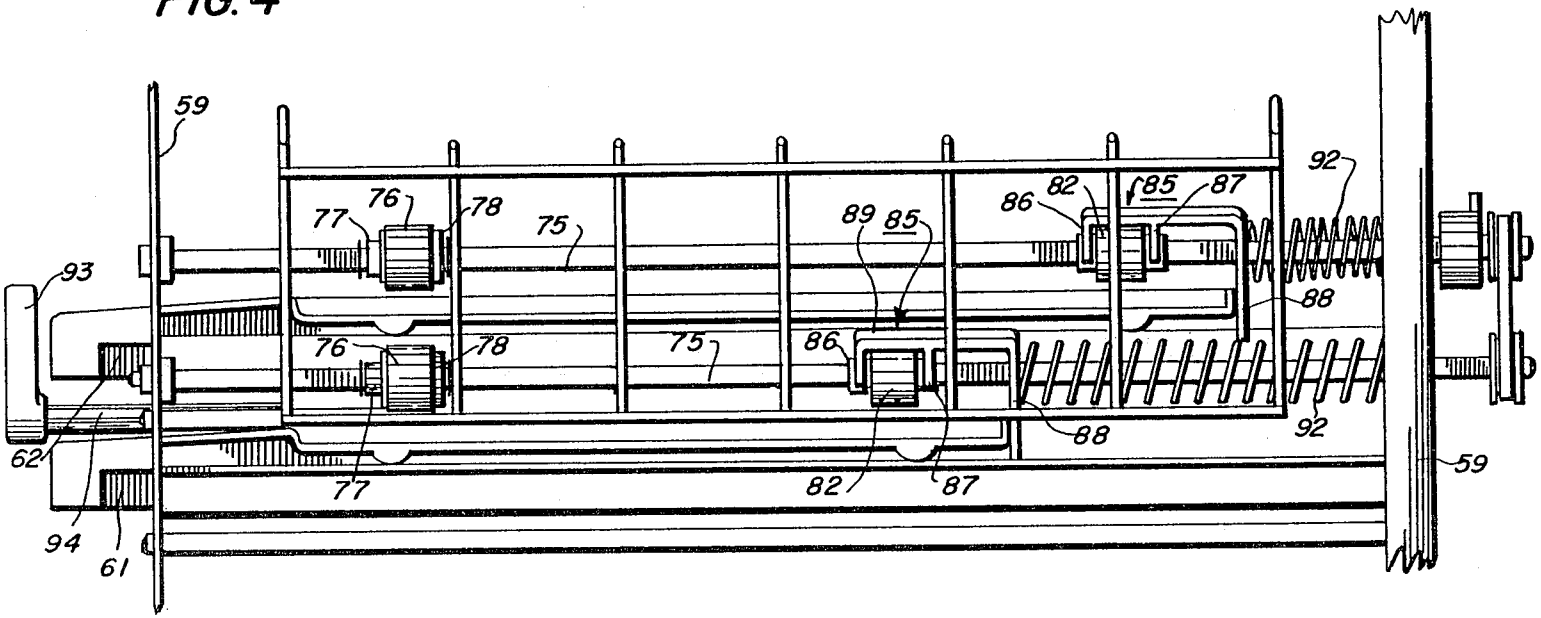
FIG. 4 is a front view of the sheet feeding apparatus of the present invention.
Figure 5:
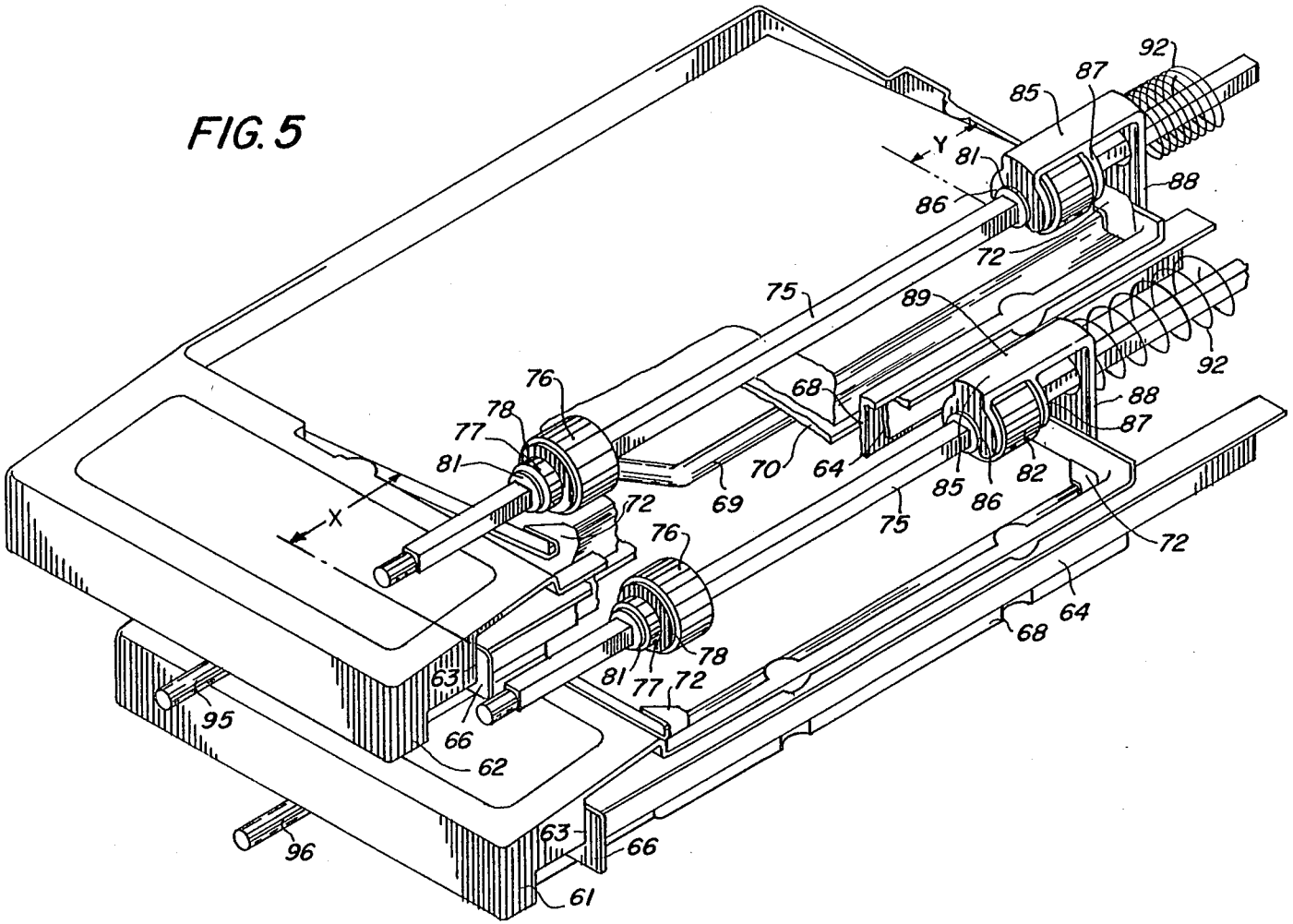
FIG. 5 is an isometric view of a dual cassette and feed roller assembly according to the present invention.

Referring more particularly to FIGS. 2–6 wherein the sheet feeding apparatus is shown in greater detail. In FIG. 2 the sheet feeding apparatus is illustrated with two cassette sheet supplies each with its own roll separator feeder according to the invention. It should be noted, however, that the sheet feeder of the present invention is also applicable to systems wherein only a single cassette and feeder is provided. The cassettes 61 and 62 are each slidingly mountable on a pair of guide rails 64 as they are inserted into the sheet supply cavity from the front of the copying machine. The guide rails 64 are each mounted at opposite ends in parallel machine frame members 59. As shown in FIG. 5 each cassette is inserted until stop members 66 on the guide rails interrupt further travel of the cassette onto guide rails by engaging on the stop member 63 of the cassette 62.

Figure 6:
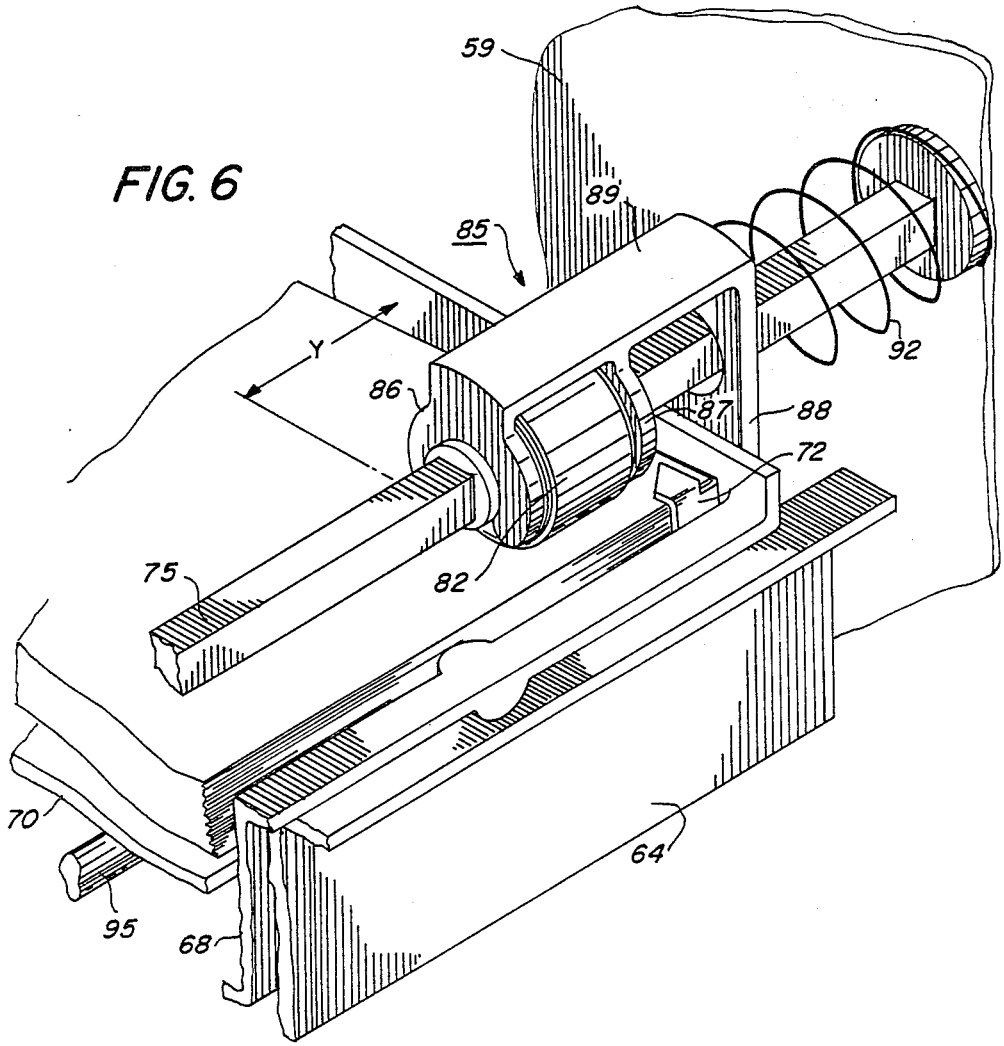
FIG. 6 is an enlarged isometric view of the feed roll drive shaft and feed roll yoke assembly of the present invention.

As shown in FIGS. 5 and 6 the cassettes 62 comprise a generally box like configuration with a sheet holding cavity in the center surrounded by thin walls 68. The floor of the cassette has an aperture 67 through which a lifting tongue 69 lifts a tray 70 bringing the sheet supply into feeding engagement with the feed rolls as will be more fully described later. The tray 70 is pivoted about its sheet feeding trailing edge so that the sheet supply is raised up above the height of the wall 68 at the front of the cassette. Pivotally mounted on the side walls of the cassette are two arms with corner snubbers 72 on the other end of the arms. The snubbers are arranged to ride on the corners of a stack of sheets inhibiting the forward motion of the corners of the sheets when a sheet is fed in the forward position.

As more completely seen in FIGS. 5 and 6, feed roll shafts 75 which are suitably journaled in front and rear frame member (not shown), are generally square in cross section. Feed roll shaft 75 has one roll fixedly mounted in the axial direction to the shaft. The fixed feed roll 76 comprises a hub 77 mounted on shaft 75, the hub having a round circumference with the feed roll 76 mounted on the hub. An overrunning spring clutch 78 is mounted between the hub and the feed roll and the whole assembly is held in place with snap rings 81. The feed roll 76 is fixedly mounted in the axial direction a short distance in from the side of the paper supply. Typically this distance is of the order of about two inches and may be maintained by aligning all cassettes whatever size sheet material they may accomodate such that the left hand edge of the cassette box is the same distance X (see FIG. 5) from the end of the cassette to the stop members 66.

The axially movable feed roll 82 at the opposite end of feed roll shaft 75 is of the same construction as the fixed feed roll in that it is also mounted on a hub having a round circumference and also has an over-running clutch. It differs from the fixed feed roll 76 in that it is axially movable on the feed roll shaft 75. Positioning of the movably mounted feed roll 82 on the feed roll shaft is achieved by means of yoke 85 which comprises two arms 86 and 87 axially mounted on shaft 75 positioned respectively on the two sides of the movable feed roll. The two arms are structurally linked together by support member 89 which also supports vertical positioning arm 88. As may be more clearly seen from FIGS. 5 and 6, support arm 88 is sufficiently long to engage the leading side wall of the cassette 68 as the cassette slides down the cassette guide rails during insertion. Since the movable feed roll assembly is biased by means of axial spring 92, for example, toward the fixed feed roll, upon insertion of a cassette the movable feed roll yoke 85 and the movable feed roll are urged in a direction away from the fixed feed roll 76. Once the sheet cassette is in position the spring continues to urge the yoke assembly 85 toward the feed roll thereby insuring that the movable feed roll is maintained in proper position. The distance "Y" as seen in FIGS. 5 and 6 is selected to provide positioning of the movable feed roll the same distance toward the center from the outside edge as the fixed feed roll is from the other edge of the copy sheet.

Referring now to FIGS. 2, 3 and 4 wherein two sheet cassettes and two feeders in the same copying machine are described. This facilitates copying on different size sheets merely by selecting the cassette having the paper size desired. This is accomplished by means of selection lever 93 and lifting tongues 69. Rotating lever 93 in a counterclockwise direction rotates shaft 94 and through mechanical linkage (not shown) on the opposite frame member this motion rotates lifting tongue shaft 95 (see FIGS. 2 and 5) counterclockwise. As shaft 95 is rotated lifting tongue 69 is inserted into the aperture of the top cassette thereby lifting the tray in the top cassette up so that it is in feeding engagement with the feed rolls. Rotating the lever 93 in a clockwise direction rotates shaft 94 through the same mechanical linkage and rotates the lifting tongue shaft 96 counterclockwise into the aperture of the bottom cassette thereby lifting the tray in the bottom cassette up so that it is in feeding engagement with the feed rolls. In this manner only a single sheet cassette is maintained in feeding engagement with its respective feed roll.

In operation a cassette is manually placed on the guide rail entrance and pushed down the guide rails until the stop member of the cassette and rail abut each other. As the cassette slides down the rail the leading wall of the cassette engages the yoke positioning arm moving it against the force of the spring bias toward the opposite wall of the copying machine. As the yoke positioning arm moves it urges the movable feed roll also toward the opposite wall of the copying machine.

When the cassette is fully inserted the fixed feed roll and the movable feed roll are both substantially the same distance from the respective edges of sheet material. To feed a sheet the cassette selector lever is turned to engage the lifting tongue thereby raising the selected cassette tray and thereby the stack of sheet material into feeding engagement with the feed rolls. To feed a sheet the feed roll shaft is driven clockwise to drive the topmost sheet forward. As the sheet begins to move forward the leading edge corners are maintained in place by the corner snubbers, forming a small buckle until the size of the buckle becomes so large it snaps the corners of the sheets out from under the snubbers and permits the sheet to be fed in a forward direction. The feed rolls may be activated in any suitable manner as this does not form a part of the present invention.

The patents and texts referred to specifically in this application are intended to be incorporated by reference into this application.

In accordance with the invention, an improved sheet feeding apparatus is provided which enables the automatic adjustment of the feed rolls to enable the feeding of sheets of various sizes from cassettes. While this invention has been described with reference to the specific embodiments described it will be apparent to those skilled in the art that many alternatives, modifications or variations may be made by those skilled in the art. For example, while this invention has been described with reference to a forward buckle sheet feeding system it is equally suitable to use with other sheet feeding systems. For example, it could be used in a reverse buckle sheet feeding apparatus. Accordingly, it is intended to embrace all such alternatives and modifications as may fall within the spirit and scope of the appended claims.

What is claimed is:

1. Sheet feeding apparatus comprising:

a sheet cassette;

a frame having a first and second opposing parallel frame members;

a rotatably driven feed roll shaft mounted between said first and second frame members said shaft having a feed roll fixedly mounted thereon;

a second feed roll axially movably mounted on said feed roll shaft, means to axially move said second feed roll on said shaft;

guide means mounted between said frame members for receiving and guiding said sheet cassette into feeding position with said feed roll shaft, said fixed feed roll being mounted on said shaft a fixed distance from a first side of said cassette;

said second feed roll on said feed roll shaft including means automatically responsive to the insertion and movement of a sheet cassette onto said guide means and into the feed position on said guide means to axially move said second feed roll on said feed roll shaft to a position such that said axially movable feed roll is positioned the same fixed distance from the opposite parallel side of said cassette.

2. The sheet feeding apparatus of claim 1 wherein said automatic responsive means includes a yoke axially mounted on said feed roll shaft said yoke including at least two arms such that one arm is mounted on each side of the movable feed roll.

3. The sheet feeding apparatus of claim 2 wherein said yoke includes a third arm mounted to engage the leading side of said sheet cassette as it is inserted in said guide means.

4. The apparatus of claim 1 including a spring to axially spring bias said second feed roll toward said first feed roll.

5. The sheet feeding apparatus of claim 1 wherein said cassette comprises a base support member with an aperture about in the center of the feeding lead edge, a tray member inserted within the base support upon which a stack of sheets may be placed to be fed, said tray member being pivotable about its feeding trail edge, said feeding apparatus further comprising a lifting tongue insertable through said aperature to lift the sheets of said tray member into feeding engagement with said feed rolls.

6. The apparatus of claim 5 wherein said cassette comprises corner sheet snubbers to separate individual sheets.

7. The apparatus of claim 1 wherein said sheet feeding apparatus feeds sheets in a direction perpendicular to the direction in which said cassette is guided into said frame.

8. The sheet feeding apparatus of claim 1 wherein said first feed roll is positioned a fixed predetermined distance from a first edge of sheets stacked in said cassette and said automatically responsive means positions said second feed roll the same distance from said opposite edge of said sheets.

9. Sheet feeding apparatus comprising:

a rotatably driven feed roll shaft with a first feed roll fixedly mounted on said shaft;

a second feed roll axially movably mounted on said feed roll shaft;

means to axially move said second feed roll on said shaft;

a sheet cassette;

guide means for receiving and guiding said sheet cassette into feeding position with said feed roll shaft; said fixed feed roll being mounted on said shaft a fixed distance from a first side of said cassette;

said second feed roll on said feed roll shaft including means automatically responsive to the insertion and movement of a sheet cassette onto said guide means and into the feeding position on said guide means to axially move said second feed roll on said feed roll shaft to a position such that said axially movable feed roll is positioned the same fixed distance from the opposite parallel side of said cassette.

10. The sheet feeding apparatus of claim 9 wherein said automatic responsive means includes a yoke axially mounted on said feed roll shaft said yoke including an arm mounted on each side of the movable feed roll and a third arm mounted to engage the leading side of said sheet cassette as it is inserted in said guide means whereby upon insertion of said sheet cassette to said feeding position said axially movable feed roll is positioned a distance from the opposite end of said cassette equal to said fixed distance.

* * * * *